United States Patent [19]

Schneider

[11] Patent Number: 4,505,310

[45] Date of Patent: Mar. 19, 1985

[54] LIQUID STORAGE AND DELIVERY SYSTEM FOR PROTECTIVE MASK

[76] Inventor: Wesley Schneider, 1030 N. State St., Apt. 50-F, Chicago, Ill. 60610

[21] Appl. No.: 462,614

[22] Filed: Jan. 31, 1983

[51] Int. Cl.[3] ..... B65B 3/04

[52] U.S. Cl. ..... 141/114; 141/349; 141/379; 141/392; 128/206.22; 150/55; 210/266; 215/1 C; 222/175; 222/383; 383/903

[58] Field of Search ..... 141/392, 329, 10, 114, 141/67, 68, 313-317, 346-362; 382-386; 222/175, 383, 207, 464; 150/55; 215/1 C; 383/100, 903; 220/375; 138/149; 128/206.22; 210/266

[56] References Cited

U.S. PATENT DOCUMENTS

| | | | |
|---|---|---|---|
| 2,804,995 | 9/1957 | Fee | 215/1 C |
| 2,844,275 | 7/1958 | Keller | 220/375 |
| 2,950,030 | 8/1960 | McConnohie | 222/207 |
| 3,143,429 | 8/1964 | Swanson et al. | 215/1 C |
| 3,157,204 | 11/1964 | Phillips | 138/149 X |
| 3,490,656 | 1/1970 | Taschner | 222/464 |
| 3,731,717 | 5/1973 | Potash | 141/349 |
| 3,834,570 | 9/1974 | Barr | 383/100 |
| 3,960,294 | 6/1976 | Bernard | 222/175 |
| 4,298,475 | 11/1981 | Gartner | 210/266 |

*Primary Examiner*—Houston S. Bell, Jr.

*Attorney, Agent, or Firm*—Jerry A. Schulman; Ronald A. Sandler

[57] ABSTRACT

A liquid storage and delivery system for protective masks has a hand-operable bulb siphon pump in line with conduits extending from a canteen assembly to the drinking mouthpiece of a protective mask. The canteen assembly includes structure adapted to flex in response to the partial vacuum created within the canteen assembly as liquid is withdrawn. An adapter may be used to enable use of the present system with prior art protective masks. A protective sheath covers at least a portion of the conduit to protect it against freezing, dirt, condensation, or physical damage.

26 Claims, 9 Drawing Figures

LIQUID STORAGE AND DELIVERY SYSTEM FOR PROTECTIVE MASK

BACKGROUND OF THE INVENTION

This application relates generally to delivery systems for liquids and, more particularly, to a system providing for the delivery of drinking liquids to a protective mask enabling the wearer of the mask to create a closed system for ingestion without exposing the liquid to contamination.

Use of chemically active and debilitating substances requires the use of protective masks and clothing, making normal eating and drinking impossible. When using toxic chemicals, a workman may have to plan a work schedule which provides for appropriate breaks, including time to detoxify such protective clothing and allow its removal. However time-consuming and inconvenient such procedures may be, they deal with a far less life-threatening situation than that encountered by a person under attack by chemical agents. The immediacy and reliability of the protective measures required under such attacks exemplifies most sharply the inadequacies of existing liquid delivery systems. Accordingly, with the understanding that commercial, on non-combat use of the present invention is contemplated, use under combat situations will be preferrably presented.

Chemical warfare has, in the past, been demonstrated to be of devastating physical and psychological effect. Chemical agents, such as toxic gases are pervasive, difficult to detect, create immediate and long-lasting disabling effects, and are available in substantial and sophisticated forms to cause a wide range of injury and/or disability from narcosis, discomfort, and disorientation all the way to paralysis and death.

To defend against such combat measures, attempts have been made to create protective clothing and protective masks in order to insulate a wearer from the effects of offensively-utilized tactical chemical agents. Where such clothing and/or masks are effective to shield or filter the particular chemical agent involved, the wearer will be protected so long as the integrity of the protective garb remains intact.

It is characteristic of chemical agents that, once deployed, they may remain effective for a substantial period of time afterward before naturally occurring atmospheric and meteorologic action either disperses, dilutes, or removes them from the environment. As an example, certain chemical substances dispensed in aerosol form may be degraded or altered by the action of direct sunlight, while others, being water soluble, may be "scrubbed" from the atmosphere and/or landscape during rainstorms. Nevertheless, it is an accepted consequence of such forms of warfare that protective clothing, once donned, may have to be worn for an indeterminate amount of time until it is established that the danger to the wearer has abated.

Protection of the wearer is only one aspect of such protective garments. Another consideration is the ability of the wearer to carry out assigned duties even when prolonged use of such protective clothing is required. This means that such garments must not only enable the wearer to see and to communicate, but, advantageously, must also make some provision for the ingestion of liquids in order to replace those liquids lost by the body through perspiration which may be heightened by the wearing of protective clothing of impermeable or semi-permeable characteristics, and by increased or stimulated body reactions resulting from participation in frightening or stressful situations.

Exemplary of a protective mask designed to meet such emergency situations is the mask illustrated and discussed in U.S. Pat. No. 3,731,717, issued May 8, 1973. Other versions of such masks include a full, overlapping hood which completely covers the wearer's head, neck, and portions of the shoulders, but which depends for its effectiveness upon a system of air filtration typified by the mask shown in the above-mentioned patent.

The wearer's incoming air supply is directed through a canister containing activated charcoal or other mechanical and chemical filtering agents selected to be effective against the particular chemical agent or agents expected to be encountered. Other portions of the mask must form a substantially air-tight protective fit about the wearer's face and head. This is important because some chemical agents are absorbed not only through the respiratory system, but may enter the body through exposed skin surfaces. Transparent eye pieces are provided to enable the wearer to see through the mask, however, the range of vision is somewhat obstructed by the non-transparent portions of the mask.

Thus, when the protective mask is properly in place, the wearer is unable to eat or drink normally without breaching the integrity of the mask's protective features. This poses a critical problem, particularly with respect to body fluids, which must be constantly and continuously replenished to avoid the serious effects of dehydration.

The above-mentioned patent provides a means by which the wearer of such a mask may ingest liquids without requiring removal of the mask. As a part of the mask construction, a mouthpiece mounted on the inside of the mask is positionable to engage the wearer's mouth. An inlet tube attached to the mouthpiece extends through an air-tight fitting to the exterior of the mask, with the tube terminating in a plug.

A standard United States Army canteen is fitted with a cap having a built-in fitting to accept the plug formed at the end of the inlet tube so that when the plug is inserted into the cap, a closed system is created which includes the interior of the canteen, the interior of the cap and plug, the inlet tube, and the mouthpiece. However, use of such a system provides serious inconveniences and disadvantages which serve to complicate the procedure for obtaining such liquids and, in the case of a combat soldier, exposes the soldier to unwarranted hazards and dangers encountered during the conduct of the soldier's assigned mission.

As set forth in said patent, and as set forth in U.S. Army instruction manuals, such as No. 3-54 EL/2, at ORDG. 1038-29, pp. 2-49 to 2-50, use of the above-described system requires the soldier to remove the canteen from its holder, remove the protective flap covering the canteen cap, visually locate the plug at the end of the drinking tube and visually locate the cap on the canteen, insert the plug into the cap, and elevate the canteen above the level of the mouthpiece so that the liquid will flow under the influence of gravity from the canteen, down the tube, and through the mouthpiece. This type of closed system is further complicated because the canteen itself cannot be vented to the atmosphere or else the liquid contained therein will become contaminated by the chemical agent present. This means that constant flow will not take place by gravity alone.

In order to remedy this situation, the user of such a system is instructed to blow through the mouthpiece in order to inject air into the canteen, and to thereafter suck liquid from the canteen via the drinking tube and mouthpiece. Such blowing and sucking operations are tiring and time-consuming, and seriously limit the rate at which the liquid can be drained from the canteen. Under conditions which have already created physical and psychological stress, such as those encountered on the battlefield, any additional physical effort should preferrably and necessarily be avoided.

Another disadvantage of the above-described system is that the user must use two hands, which means whatever activity the user is carrying out must be interrupted. The user must also raise the canteen above the level of the mouthpiece and hold it there in a tiring and awkward posture. Apart from the physical effects and consequent fatigue, this means that the user may be forced to maintain a relatively vulnerable posture in order to perform so simple an act as the taking of a drink.

When the user has finished drinking, the plug must be removed from the canteen cap, the protective flap must be sealed across the cap socket, and the canteen must be returned to its holder. During this operation, of course, the cap and plug are exposed to possible contamination by any chemical agents present in the air, and must be decontaminated prior to connection every time a drink is required.

Given the nature of certain chemical agents, the toxic effects of such agents are enhanced when they are utilized at night, particularly those agents which are degraded by higher temperatures or direct sunlight. This means that use of protective garments and liquid delivery systems for such garments may most frequently occur when visibility is at its poorest, thereby jeopardizing the secure and correct decontamination and connection of the above-described system.

Accordingly, the need exists for a liquid delivery system which would substantially overcome the above-identified problems, thereby adding to the security and continued health and well being of one forced to adopt the use of such protective clothing and masks for indeterminate periods of time. The need also exists for such a delivery system to be readily adaptable to protective equipment already in widespread use, making deployment of such a system compatible to both old and newly-manufactured equipment.

BRIEF DESCRIPTION OF THE INVENTION

A fluid delivery system suitable for use with protective masks includes a delivery tube sealed, at one end, to the drinking mouthpiece contained within the mask and attached at its other end to a bulb-type siphon pump. A supply tube is attached liquid-tightly at one end to the bulb siphon pump and, at the other end, to a plug member.

A canteen structure is provided with a removable cap having a socket which cooperates with the plug member at the end of the supply tube to form an air-tight positive fit when the plug is inserted into the socket. Means are provided in the canteen construction to enable liquid to be withdrawn from the canteen without requiring venting of the canteen's contents or injection of air into the canteen in order to equalize the air pressure within the canteen with the atmosphere. In one version of such a construction, the canteen structure includes a rigid outer wall and an inner pliable liner within which the liquid is carried, and a selectively openable and closeable valve enabling the air pressure between the inside and the outside of the rigid portion of the canteen structure to be equalized while the liner collapses as liquid is withdrawn therefrom. In another version, the canteen structure is formed with sidewalls fashioned in a flexible, bellows-like configuration, giving the canteen structure sufficient flexibility to enable the canteen structure to flex during the withdrawal of liquid therefrom without sustaining permanent deformation or damage due to material fatigue.

Another feature of the present invention is a flexible drain tube attached to the interior of the canteen structure cap and extending into the canteen, and having a weighted end distal from the cap whereby the drain tube will automatically drop to the lowermost portion of the canteen, i.e., that portion of the canteen at which the liquid level is at its highest regardless of the position in which the canteen is held.

The supply tube is preferably coiled to present a compact, easily stored construction when not in use, and which may be stretched to connect the mask and the canteen structure, when the canteen structure is carried in a typically belt-worn carrying case. The canteen then need not be removed during the drinking operation. A protective insulating sheath may be used to cover the supply tube as an added measure of protection against freezing, condensation, physical damage, or to coordinate use of the system with selected uniforms or camouflage requirements.

An additional chemical and/or mechanical filter may be inserted to provide an additional measure of protection against contamination of the liquid.

Hand-pumping of the bulb-type siphon pump thus provides a supply of liquid extending in a path from the interior of the canteen structure to the users mouth without being exposed to the atmosphere and, thereby, any chemical agent or contaiminant present. The pump may be supplied with a check valve preventing the contents of the supply tube from draining back into the canteen between uses, thus making it unnecessary to "prime" the system each time it is used.

BRIEF DESCRIPTION OF THE DRAWINGS

These and further aspects of the present invention may best be understood by referring to the accompanying drawings, wherein.

DETAILED DESCRIPTION OF THE INVENTION

Figure 1:
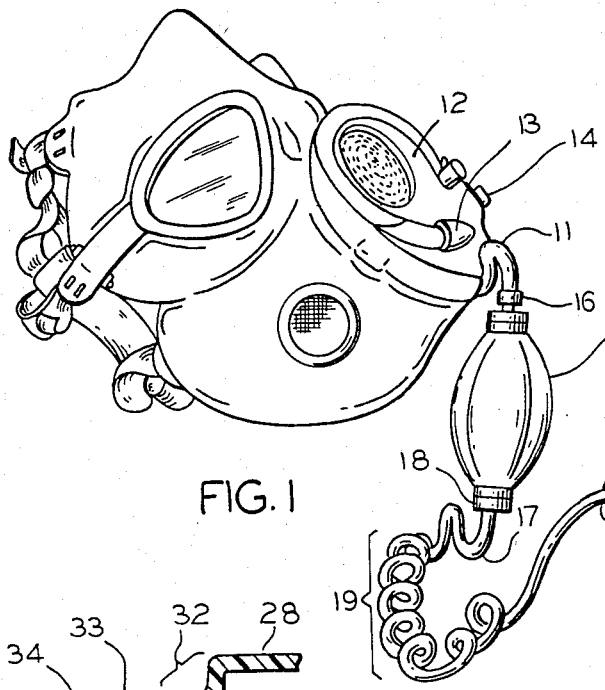
FIG. 1 is a view of the system of the present invention showing connection of the system to a protective mask.

Referring now to FIG. 1, the numeral 10 indicates generally a protective mask of the type hereinabove described. One such mask currently in distribution by the United States government is identified as the M17A1 mask. As an integral part of the mask structure, an inlet tube 11 extends, via voice transmitter housing 12 and fluid-tight fitting 13 to the interior of mask 10 where it is liquid-tightly secured to a drinking mouthpiece not herein specifically shown. Connection of the inlet tube to the mouthpiece may be made in any number of convenient or well-known manners to provide a permanent and durable liquid-tight fit. Typically, the mouthpiece is hinged and spring-biased to remain away from the user's mouth during normal conditions. An operating tab 14 extending to the exterior of mask 10 may be used to move the mouthpiece down toward the user's mouth where it may be grasped by the user until drinking is completed. Upon release, the tube will return to its original rest position within mask 10.

Inlet tube 11 is attached at its other end to bulb siphon pump 15 at fluid tight fitting 16, again, by any known method which provides a durable and liquid-tight connection. Pump 15 is preferably formed of heavyweight rubber or rubber-like material which will flex easily when compressed by the user's hand, and which will retain its liquid-tight properties over extended periods of time.

Figure 2:
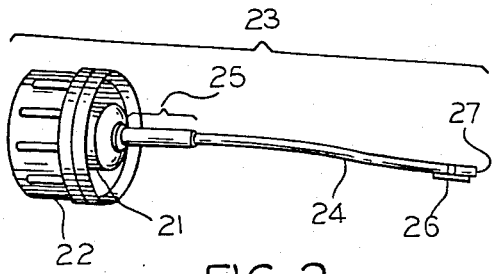
FIG. 2 is a perspective view of the cap and drain tube assembly insertable into the canteen structure.

The inlet side of pump 15 is attached to supply tube 17 at fluid-tight fitting 18. Supply tube 17 is preferably permanently coiled about a substantial portion of its length, as shown at 19, so that it may be compactly stored yet may be extended over a relatively long distance. Supply tube 19 terminates in plug 20 which, in the present preferred embodiment, is of a type already known and in use, its distinguishing characteristic being that it cooperates with a socket construction 21 which, in the preferred embodiment illustrated, is an integral part of canteen cap 22. As an example, the plug structure shown in U.S. Pat. No. 3,731,717 may be utilized. When assembled, plug 20 extends into canteen cap 22 as seen in FIG. 2. Cap cover 52 may be provided as hingedly attached to cap 22 to cover and protect socket assembly 22 when not in use.

Use of mechanical restraining means, such as a rubber strap 57 or retaining spring, may be atatched at one end to cap 22 and at the other end to plug 20 to prevent accidental disengagement.

Referring now to FIG. 2, a preferred version of cap construction 23 includes canteen cap 22, socket assembly 21, and drain tube 24 liquid-tightly connected to socket assembly 21 as shown in 25. Again, connection of tubes such as drain tube 24 to socket assembly 21 may be accomplished in a number of well known manners to perform the function required in the present invention.

Drain tube 24 is formed of a thin, flexible, plastic material selected to avoid stiffening or hardening in low temperatures, and includes a ballast piece 26 positioned proximate inlet 27 of drain tube 24. The weight of ballast piece 26 is selected to deflect drain tube 24 by the force of gravity downward within canteen 28 such that inlet 27 will be positioned at that point within canteen 28 where undispensed liquid will also be drawn by gravity. This result will obtain regardless of the position in which canteen 28 is placed.

Referring now to FIG. 1, numeral 28 indicates a canteen construction which, in a preferred embodiment, is formed from a heavy gauge polyethylene-type plastic material which, when properly shaped, may be flexed many times without suffering material fatigue and failure.

Figure 5:
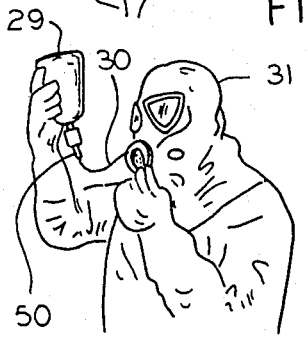
FIG.5 (PRIOR ART)
FIG. 5 is a graphic illustration of the prior art.

FIG. 5 illustrates generally use of a standard canteen 29 manufactured from the same type of material molded, however, into an essentially rigid structure not designed to flex during use. As will be hereinbelow discussed, the capability of canteen 28 to successfully absorb such flexing action is an important feature of the present invention.

As discussed above, conventional practice requires the withdrawal of liquid from canteen 29 via suction tube 30 directly into the user's mouth. The suction force required to draw liquid from canteen 29 is provided by the user sucking on the internal mouthpiece of protective mask 31.

As is well known, with a structure having rigid walls, as the contents of the structure are withdrawn by suction, a partial vacuum is created within the structure as the volume of air originally present in the structure expands to fill a larger volume. When the pressure differential between the interior pressure of the structure and the external atmospheric pressure becomes too great, the structure may collapse or permanently deform. In order to prevent this occurrence, as described above, users of the system illustrated by FIG. 5 must alternately suck liquid through drinking tube 30 and blow air through drinking tube 30 in an attempt to equalize the pressure inside canteen 29 with the outside atmospheric pressure.

Figure 3:
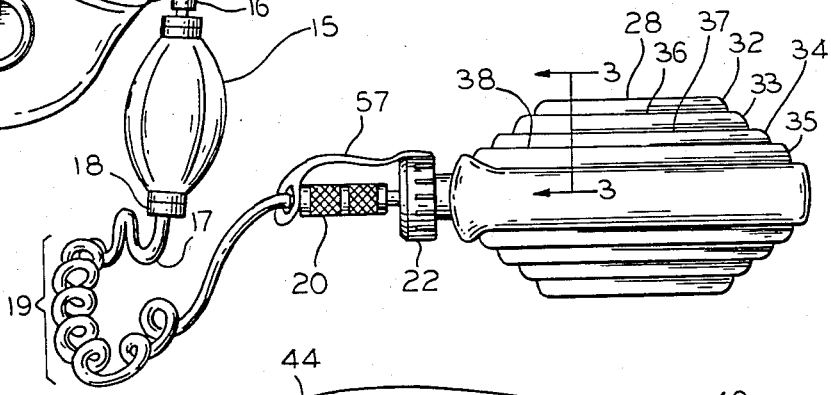
FIG. 3 is partial sectional view along 3—3 of FIG. 1.
Figure 3:
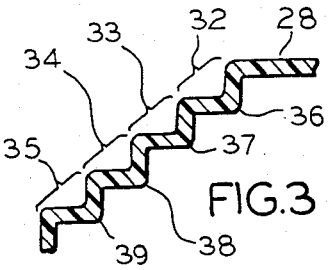

Referring now to FIG. 2 and FIG. 3, canteen 28 of the present invention is preferably molded with a cross-section of individual stepped sections such as those shown at 32, 33, 34 and 35 joined at bends, or "knees" 36, 37, 38 and 39. The combination of the stepped sections and bends enables the sides of canteen 28 to flex or partially collapse in a bellows-like manner in response to the differential in pressure caused by the draining of liquid from canteen 28. It is a well known characteristic of such plastic materials that they retain a living memory of the original shape within which they were molded and, when such bends are properly molded, may be distorted from and returned to said original shape many times without sustaining material fatigue or structural damage.

Figure 4:
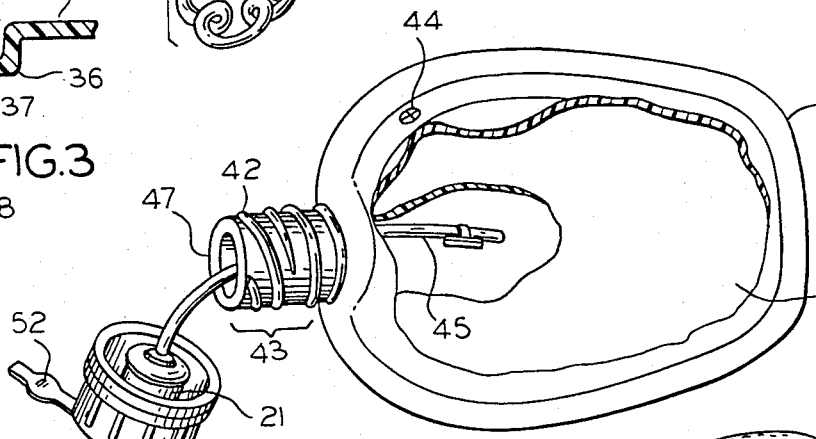
FIG. 4 is a partial sectional view of one aspect of the present invention illustrating a canteen structure having an interior liner.

Referring now to FIG. 4, in yet another version of the present invention, a canteen structure may include a more or less conventional rigid outer shell 40 within which a thin, flexible bag-like liner 41 may be disposed. The liquid to be dispensed will be contained within liner 41. Preferrably, liner 41 may be of a size to fill the interior of shell 40 and extend through the neck 42 of said shell, as at 47, thereafter to be sealed off by screwing cap 22 onto the threads 43 typically formed on the exterior surface of neck 42.

As shown at 44 of FIG. 3, a valve structure, or plug, may be utilized to allow the interior of shell 40 to communicate with the atmosphere. Thus, as liquid is drawn through drain tube 45 from liner 41, liner 41 is free to collapse within rigid shell 40, allowing easy withdrawal of the liquid. Valve or plug 44 may be constructed so as to create a liquid-tight seal when in the closed position so that shell 40 may be used as a canteen in a conventional manner without a liner where protection from contaminating agents is not a consideration.

Once liner 41 is completely evacuated, it may be discarded and a fresh, sterile, liner inserted and refilled to provide another safe source of liquid.

Preferrably, inlet tube 11, pump 15, supply tube 17, and plug 20 remain integral with and permanently attached to mask 10, and may be conveniently and unobtrusively stored with mask 10 in a more or less conventional carrying container.

Figure 6:
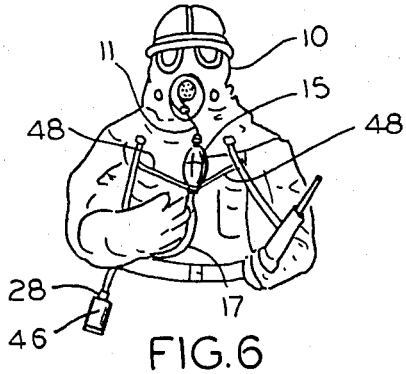
FIG. 6 is a graphic illustration of the use of the present invention.

Use of the present invention may be illustrated by referring to FIG. 6. After donning mask 10, the user stretches supply tube 17 to enable plug 20 to reach canteen 28 carried, for example, in holder 46. After carrying out any prescribed decontamination of plug 20 and/or cap 22, the user inserts plug 20 into cap 22 to complete a flow path from canteen 28 to the drinking mouthpiece in mask 10.

By grasping pump 15 and squeezing, liquid will then be drawn from canteen 28 and will be delivered to the user via supply tube 17, inlet tube 11, and the mouthpiece of mask 10. Such delivery requires use of only one hand to operate pump 15, and may be effected whether the user is in an upright, prone, or other position. Retainer straps 48 may be provided to anchor pump 15 to the user's clothing in order to keep the position of pump 15 constant.

Plug 20 may be left permanently attached until canteen 28 is empty, thus obviating the need to reconnect the system everytime the user wishes to drink.

Figure 7:
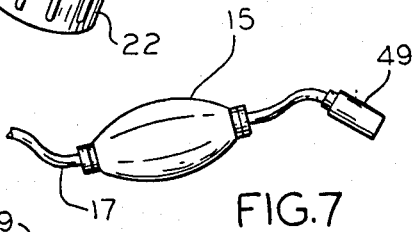
FIG. 7 is a partial perspective view of an adapter as part of the present invention.

FIG. 7 illustrates yet another version of the present invention consists of a construction including plug 20, supply tube 17, pump 15, and an adapter including a liquid-tight connection to pump 15 at one end, and a connector 49 corresponding in construction to socket assembly 21 at the other end. This version would enable attachment to the standard coupling arrangement now in use as shown in FIG. 5, and would convert such an arrangement to utilize the present invention. Standard coupling 50 would then be connectable to adapter 49 and, thereby, to the remaining components in the present invention, making immediate conversion of all existing protective masks feasible. Connection to adapter 49 may be done on an as-needed basis, under field conditions, using proper decontaminative procedures, or it could be done prior to such use on a permanent basis, to be stored wtih the mask. Permanent connection may be enhanced by utilizing an air-tight protective covering formed, e.g. from shrink-wrap material to prevent disconnection and as added protection from air-borne chemical agents.

Figure 8:
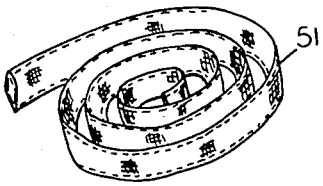
FIG. 8 is a perspective view of a protective sheath for the present system.

In FIG. 8, a protective sheath 51 is shown intended to provide protection to supply tube 17. Sheath 51 may be insulated to counter such problems as freezing of liquid in supply tube 17 in cold weather, or preventing condensation along supply tube 17 in humid weather. Protection may also be afforded against dirt, abrasion, or kinking. Sheath 51 may be provided in a variety of colors, based upon demands of uniform coloration or camouflage, or to indicate the conditions with which sheath 51 is intended for use, such as blue for cold weather, green for humid weather, and the like.

In use, sheath 51 may be drawn over plug 20 and extend to or past pump 15, and may be stored with mask 10 until its use is required. Other sheath constructions may be openable lengthwise, as by zippers, snaps, or the like, making use of such a sheath possible even after connection to canteen 28 has been made, without requiring disconnection and attendant decontamination of couplings.

Testing and use of the present invention and the system characterized by that shown in FIG. 5 has demonstrated the increased efficiency provided by the present invention. Test results show that liquid may be delivered to the user at twice the rate of the prior art system.

In yet another aspect of the present invention, provision may be made to include an additional in-line filtration element for those circumstances where the liquid itself is suspected of containing contaminating material. A cartridge-type combined mechanical and chemical filter may be made a part of the present invention in a number of effective manners.

One such filter is of the general type wherein contaminants such as microorganisms and water-borne impurities are removed in a single pass from the liquid supply to the user's mouth by packings of both activated charcoal and microbicidal resins. One such construction is described in U.S. Pat. No. 4,298,475, and is sold under the trademark Pocket Purifier as manufactured by Calco, Ltd., of Rosemont, Ill.

Said filtration element is preferrably provided in removable and replaceable versions insertable between canteen 28 and mask 10, and may find particular usefulness where canteens may have been filled with water which requires further treatment to make it safely potable, yet the canteens which hold the water cannot be opened for purification because of the presence of airborne chemical agents.

Figure 9:
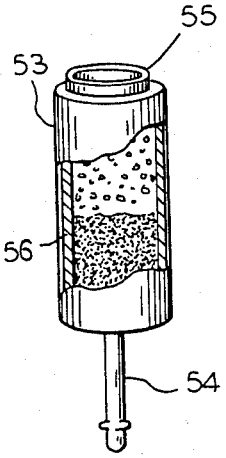
FIG. 9 is a partial sectional view of an in-line filtration cartridge holder.

In FIG. 9, a filtration cartridge holder 53 is shown, adapted at one end 5A to couple with cap 22 of canteen 28, and at its other end 55 to couple with plug 20. Holder 53 may have a filtration cartridge insert 56 of the general type described above removably held therein, which may be replaced when spent. While cartridge 56 may be placed wherever convenient, one advantage to placing it at canteen cap 22 is to avoid passible contamination of the system elements downstream of canteen 22. Use or replacement of holder 53 and cartridge 56 would be subjected to the same decontamination procedures followed when attaching plug 20 to cap 22.

While the foregoing has presented various embodiments of the present invention, such embodiments are exemplary only, and are not intended to limit the spirit and scope of the invention. It is expected that others will perceive variations which, while varying from the foregoing, do not depart from the spirit and scope of the invention as herein described and claimed.

I claim:

1. System for delivering liquid to a protective mask, said mask of the type having a drinking mouthpiece assembly on the interior thereof, positionable at the mouth of a user for ingestion of said liquid, said system comprising:

a first tube liquid-tightly attached to said mouthpiece assembly;

a hand pump having an inlet and an outlet;

said first tube liquid-tightly attached to said outlet;

a second tube, one end of which is liquid-tightly attached to said inlet;

a plug liquid-tightly attached to the remaining and of said second tube;

a canteen assembly including means for storing a quantity of said liquid therewithin, said canteen assembly including a coupling to join said plug liquid-tightly thereto;

a drain tube liquid-tightly attached to said coupling and disposed within said liquid storage means;

said liquid storage means, said drain tube, said coupling, said plug, said second tube, said pump, said first tube and said mouthpiece defining a liquid flowpath through which liquid may be withdrawn from said storage means; and means to compensate for the pressure differential between said storage means and atmospheric pressure without exposing said liquid to the atmosphere.

2. The apparatus as recited in claim 1 wherein said canteen assembly includes a unitary hollow structure terminating in a neck portion, said structure having upstanding first and second walls oppositely disposed and spaced-apart one from another, and said pressure differential compensation means includes means for enabling at least one said wall to flex toward the other.

3. The apparatus as recited in claim 2 wherein said flexing means includes a plurality of overlying wall segments joined in bellows-like fashion to form at least one said wall in a stepped generally pyramidal configuration, each said wall segment being smaller than the immediately subjacent wall segment and larger than the immediately suprajacent wall segment.

4. The apparatus as recited in claim 1 wherein said canteen assembly includes a substantially rigid outer shell terminating in a neck portion, and said liquid storage means includes a flexible bag-like liner disposed within said shell, and said pressure differential compensation means includes means to vent said shell to the atmosphere without breaching said liner.

5. The apparatus as recited in claim 4 wherein said vent means comprises an opening formed through said shell.

6. The apparatus as recited in claim 5 wherein said vent means includes means to selectively seal and unseal said opening.

7. The apparatus as recited in claim 1 wherein said hand pump is a bulb siphon pump.

8. The apparatus as recited in claim 2 wherein said system includes a check value to prevent liquid from draining back into said liquid storage means after operation of said pump.

9. The apparatus as recited in claim 1 including an in-line filter through which said liquid passes prior to reaching said mouthpiece.

10. The apparatus as recited in claim 9 wherein said in-line filter is disposed between said coupling means and said bulb means.

11. The apparatus as recited in claim 1 wherein said drain tube is liquid-tightly attached at one end to said coupling, with the remaining end extending into said liquid storage means; and a weight positioned proximate said second end to bend said tube to engage said liquid in said liquid storage means.

12. The apparatus as recited in claim 1 including an insulating cover positionable over at least said first tube.

13. The apparatus as recited in claim 1 wherein said system further includes means for securing said hand pump to a user's person.

14. System for delivering liquid to a protective mask, said mask of the type having a drinking mouthpiece assembly on the interior thereof positionable at the mouth of a user for ingestion of said liquid, and an inlet tube liquid-tightly attached to said mouthpiece and extending outside said mask, said system comprising:

a hand pump, the outlet of which is liquid-tightly attachable to said pump inlet tube;

a supply tube liquid-tightly attached to the inlet of said pump;

a plug assembly liquid-tightly attached to said supply tube;

a canteen assembly including means for storing a quantity of said liquid therewithin, said canteen assembly including means for coupling said assembly liquid-tightly thereto;

means for draining said canteen assembly, said drain means liquid-tightly attached to said coupling means and disposed within said liquid storage means, said liquid storage means, said drain means, said coupling, said plug, said supply tube, said pump, said inlet tube and said mouthpiece defining a liquid flowpath through which liquid may be withdrawn from said storage means; and means for compensating for the difference in pressure between the interior of said storage means and atmospheric pressure without exposing said liquid to the atmosphere.

15. The apparatus as recited in claim 14 wherein said pressure differential compensation means includes means for enabling said canteen assembly to flex.

16. The apparatus as recited in claim 15 wherein said flexing means includes a plurality of overlying wall segments joined in bellows-like fashion to form at least one said wall in a stepped generally pyramidal configuration, each said wall segment being smaller than the immediately subjacent wall segment and larger than the immediately suprajacent wall segment.

17. The apparatus as recited in claim 14 wherein said canteen assembly includes a substantially rigid outer shell terminating in a neck portion, said liquid storage means includes a flexible bag-like liner disposed within said shell, and said pressure differential compensation means includes means to vent said shell to the atmosphere without breaching said liner.

18. The apparatus as recited in claim 17 wherein said vent means comprises an opening formed through said shell.

19. The apparatus as recited in claim 18 wherein said vent means includes means to selectively seal and unseal said opening.

20. The apparatus as recited in claim 14 wherein said hand pump comprises a bulb siphon pump.

21. The apparatus as recited in claim 14 wherein said system includes a check valve to prevent said liquid from draining back into said liquid storage means after operation of said hand pump.

22. The apparatus as recited in claim 14 including an in-line filter through which said liquid passes prior to reaching said mouthpiece.

23. The apparatus as recited in claim 22 wherein said filter is disposed between said coupling and said plug.

24. The apparatus as recited in claim 14 wherein said drain means includes a flexible tube, one end of which is liquid-tightly attached to said coupling, the remaining end of which extends into said liquid storage, said remaining end being weighted sufficiently to bend said flexible tube to engage said liquid in said liquid storage means.

25. The apparatus as recited in claim 14 including an insulating cover positionable over at least said inlet tube.

26. The apparatus as recited in claim 14 wherein said system further includes means to secure said hand pump to a user's person.

* * * * *

UNITED STATES PATENT AND TRADEMARK OFFICE

CERTIFICATE OF CORRECTION

PATENT NO. : 4,505,310

DATED : March 19, 1985

INVENTOR(S) : Wesley Schneider

It is certified that error appears in the above-identified patent and that said Letters Patent is hereby corrected as shown below:

Column 9, line 41: replace "2" with --1--;

Column 10, line 2: delete "pump";

Signed and Sealed this

*Third* Day of *June 1986*

[SEAL]

*Attest:*

DONALD J. QUIGG

*Attesting Officer*

*Commissioner of Patents and Trademarks*